United States Patent [19]

Peschardt et al.

[11] Patent Number: 4,660,735

[45] Date of Patent: Apr. 28, 1987

[54] RE-CLOSABLE CONTAINER HAVING FRANGIBLE PORTION

[75] Inventors: Preben Peschardt; Jørgen Poulsen, both of Thisted, Denmark

[73] Assignee: Thy Plast I/S, Thisted, Denmark

[21] Appl. No.: 845,699

[22] Filed: Mar. 28, 1986

[30] Foreign Application Priority Data

Apr. 22, 1985 [DK] Denmark ..... 1780/85

[51] Int. Cl.[4] ..... B65D 17/40

[52] U.S. Cl. ..... 220/276; 220/270; 220/306; 220/284; 215/256

[58] Field of Search ..... 220/276, 270, 306, 284; 215/256

[56] References Cited

U.S. PATENT DOCUMENTS

| | | | |
|---|---|---|---|
| 3,811,597 | 5/1974 | Frankenberg et al. | 220/284 |
| 4,037,746 | 7/1977 | Ver Hage | 215/256 |
| 4,165,018 | 8/1979 | Giqqard | 220/284 |
| 4,281,774 | 8/1981 | Mumford | 220/270 |
| 4,474,304 | 10/1984 | Jacobs | 220/276 |
| 4,564,115 | 1/1986 | Imhert | 220/270 |

*Primary Examiner*—George T. Hall

*Attorney, Agent, or Firm*—Thomas R. Morrison

[57] ABSTRACT

A re-closable container having a beadlike thickening (3), which is enclosed by the bent-down skirt of the inwardly depressed cap, has a collar (4) immediately beneath said thickening, under which an inside flange (12) on the part (11) of the bent skirt outside the container engages, when the cap is depressed down over the brim of the container. Weakening grooves (10) and (15) makes it possible to tear-off the part (11) of the cap with its flange (12), so that the cap can be lifted up from the container. To facilitate the tearing-off the outside part of the cap may have a narrow slot (14), which adjoins as well a circumferential weakening groove (10) as another one (15) reaching from the former and down to the free brim of the cap's skirt. When e.g. a table knife is inserted through the slot, the cap part (11) can be broken along the weaking groove (15), after which said part with its belonging flange easily can be torn-off.

2 Claims, 3 Drawing Figures

RE-CLOSABLE CONTAINER HAVING FRANGIBLE PORTION

The present invention relates to containers with a cap which, when part of the contents of the container has been removed, can be replaced tight fitting, said containers being protected against an unintented complete or partial opening during transport or warehousing.

Containers of this sort made of tinplate are well-known and are still commonly used for e.g. paints. Because of the rigidity of the material it is rather unproblematic to manufacture the container and the cap so that the cap closes perfectly tight when pressed in place. In return, you need tools for its opening which are not usual kitchen utensils. For ordinary domestic purposes containers of plastics are usual as they are easier to handle and to get rid of when emptied, because they can be sent to refuse destructor plants together with other household refuse. However, manufacturing re-closable plastic containers is not as unproblematic as making tinplate containers as it will appear from below.

As mentioned above the cap must be so tight fitting and protected against an unintentional opening that the container is "sealed", i.e. just as well closed as if it were sealed by welding or glueing. Another demand is that filling the container and mounting the cap can be carried out in existing automatic plants. Plastic containers are meant to be disposable and therefore they must be cheap in manufacture as well as to the quantity of plastics used as regards the complication of the tools necessary. The sealing, i.e. the part or those parts of the cap holding it during transport and storing, must be easy to remove without any other utensils than those found in any household, and the cap must be reliably tight fitting when the sealing has been broken and after having been opened and closed again and again.

These demands on a usable re-closable container are conflicting. Thus the demand for a small materials consumption means that the container walls and the cover become more yielding with a consequent risk of leaks, and the possibility of constructing effective sealing devices is limited by the demand that the cover must be replaceable without additional working operations, i.e. that it must be mountable by a simple pressure from above.

As examples of designs of re-closable containers can be mentioned those known from U.S. Pat. No. 4,487,329 and the German Patent Publication No. 24 05 541. The containers described in these publications are provided with a bent brim, and their caps which enclose the bent brim have a hook engaging said brim thus keeping the caps when they are pressed in place. Such containers probably meet the claim as to cheapness and the cap being easy to mount; however, the demand for tightness is not met as the bent brim will easily be deformed, e.g. by packing the stored containers closely. Especially this holds good if the container has not a circular, but a rectangular section. The tightening bead of the German patent publication does not secure effectively from leaking, firstly because it does not tighten if there is not a force pressing the groove of the lid down over it, and there will not be such a force once the sealing is broken, and secondly it increases the yielding of the bent brim. Protruding lobes or lugs for tearing off the sealing as shown in the patent publication mentioned should be avoided as they increase the risk of an unintentional removal of the sealing. In that respect the design shown in the U.S. patent specifications above is better; however, with the placing of the weakening groove shown the tightening properties are severely deminished once the sealing has been broken, especially if the container is deformed due to rough treatment.

Another example of the design of a re-closable container is described in the U.S. Pat. No. 4,362,253. By this design the sealing is torn off as an open ring when the lid is lifted, after which the latter functions as a normal lid. The disadvantage of this design is that the lid is not self-centering so that a certain accuracy is demanded when placing it both before and after breaking the sealing.

There is a design of re-closable containers known wherein the tightness is effective even after however many removals and mountings of the cap. This is obtained by the container's rim having an outside beadlike thickening round about and beneath which a groove in the inwardly pressed-down cap engages elastically. This design which will be described in more detail below is the basis of this invention, thus relating to a re-closable container of the last-mentioned sort as is indicated in the beginning of the claims and which is characteristic by the facts indicated in the characterizing part of the claims. By this all the above demands on a usable re-closable container are met as the tightening properties and a reliable sealing are made mutually independent, as it will be explained below with reference to the accompanying drawing, in which:

Figure 1:
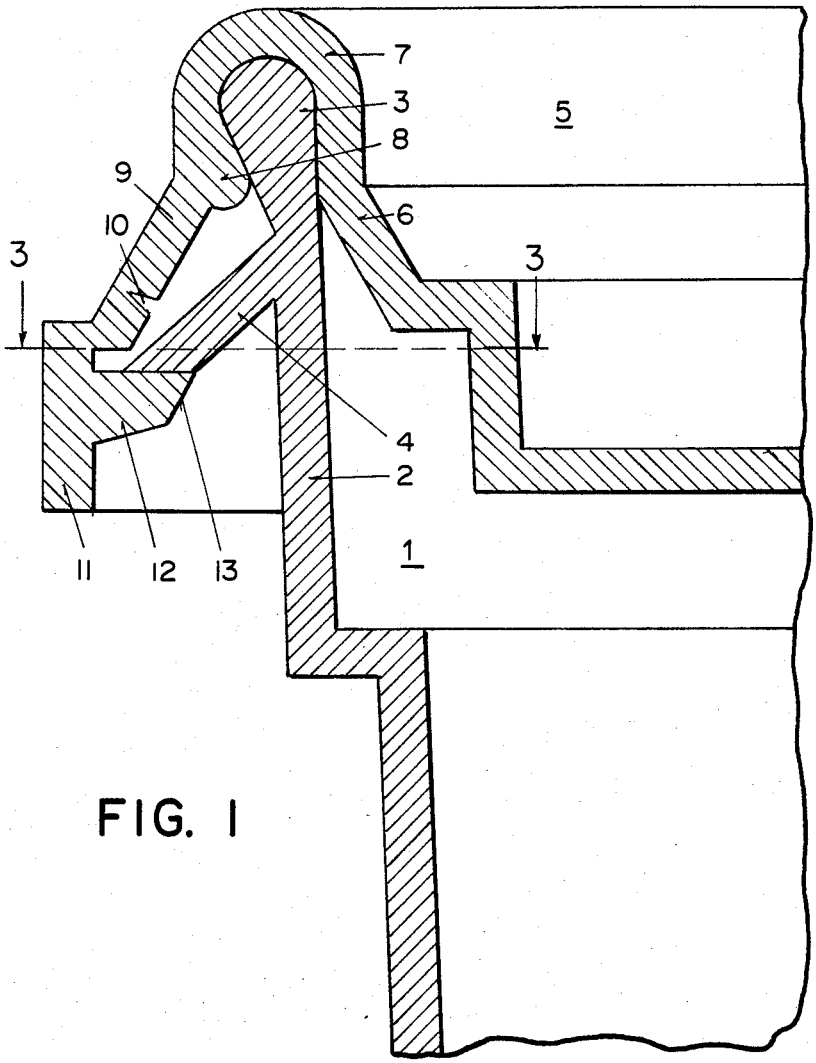
FIG. 1 shows a strongly magnified sectional view of the parts of a re-closable container which is essential for understanding the invention.
Figure 2:
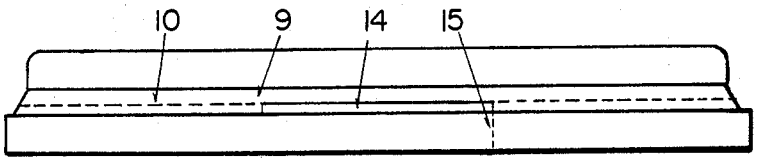
FIG. 2 shows the container cap contemplated from the side.
Figure 3:
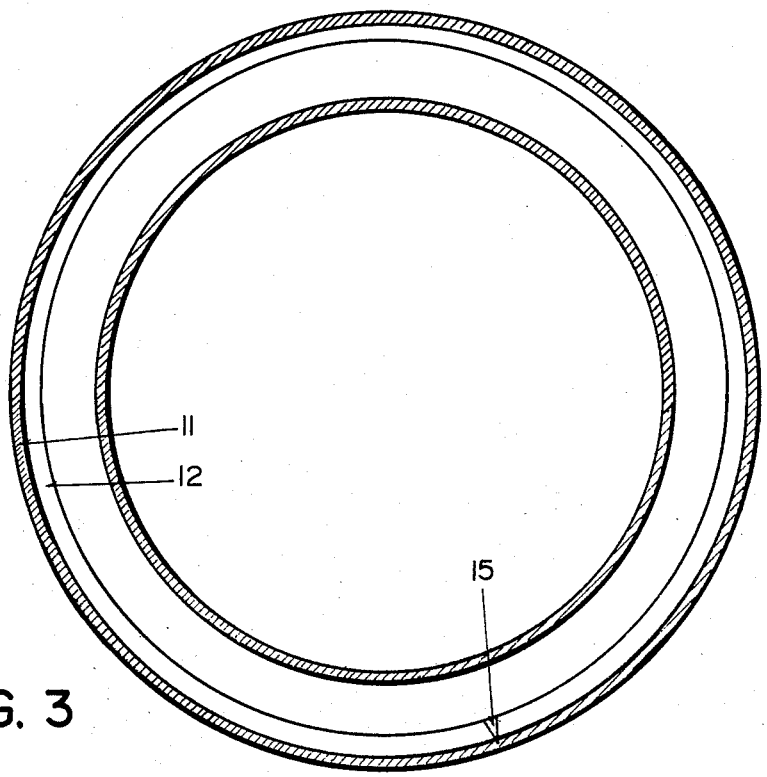
FIG. 3 shows the cap contemplated from above and a section through half of it on the line III—III in FIG. 1.

In the drawing 1 designates the very container which here is shown with a circular section, which, however, just as well might be rectangular. The wall of the container, indicated by 2, has as shown a bead-like thickening 3. The cap 5 has a part shaped as a truncated cone making it self-centering thus facilitating its mounting. The rim of the cap is folded down thus shaping a circumferential channel 7 which encloses the thickening 3 elastically ensuring tightness. As it appears the folding of the cap has a thickening 8 which serves to increase its stiffness and besides facilitates pressing down the cap due to its rounded form. The bend of the cap continues into a truncated cone 9 —if the section of the container is rectangular naturally 9 is an oblique flat—causing the downmost outer part 11 to be kept at some distance from the exterior of the container wall 2. The part 11 has an inside flange 12 which in co-operation with a collar 4 seals the container, i.e. holds the cap 5 safely. The collar 4, which is placed immediately beneath the thickened rim 3, in case the container has a circular section has the shape of a truncated cone and if the section is rectangular it will be a truncated pyramid with rounded corners, and in both cases this shape will mean that an up-turned pressure on the rim of the cap will cause the collar 4 to flatten out and be pressed against the inside of the part 9, thus preventing the cap from being pushed off. The part 9 has a circumferential weakening groove 10 the shape of which may be seen from FIG. 1, said groove being indicated with dotted lines in the FIGS. 2 and 3. To make it possible to break the sealing the section of the cap 11 has also a weakening groove 15 as shown in the FIGS. 2 and 3. This weakening groove also passes through the flange 12. As shown in FIG. 1 this flange has an oblique inner surface 13 to facilitate the depression of the cap. Said depression takes place by the collar 4 being pressed inwards and downwards, which is possible because of its shape.

As mentioned earlier projecting devices to pull at, when the sealing must be broken, should be avoided. According to a further embodiment of the invention the part 9 of the cap has a narrow slot 14 adjoining the weakening groove 15. Therefore breaking the sealing can be started e.g. by inserting a knife into the slot 14 and breaking the part 11 of the cap along the weakening line 15, after which said part can easily be torn off along the weakening line 10.

We claim:

1. A re-closable container of the sort having a bead-like thickening (3) along its brim, said brim being enclosed by the bent-down skirt (7,9,11) of an inwardly pressed-in cap (5), characterized in that said container (1) has an obliquely projecting collar (4) placed beneath the thickened brim (3), and said collar co-operates with an inner flange (12) on the part (11) of the cap (5) being outside the container wall (2) after the pressing-in, and that the cap besides has weakening lines (10,15) for tearing-off the part (11) of the cap which has the flange (12).

2. A re-closable container according to claim 1, characterized in that said outer section (9,11) of the cap (5) on part of its periphery is provided with a narrow slot (14) in immediate connection with a circumferential weakening groove (10), and reaching from the latter and down to the lower brim of the skirt another weakening groove (15).

* * * * *